US006475961B2

(12) United States Patent
Lokkesmoe et al.

(10) Patent No.: US 6,475,961 B2
(45) Date of Patent: Nov. 5, 2002

(54) LUBRICANT COMPOSITIONS HAVING ANTIMICROBIAL PROPERTIES AND METHODS FOR MANUFACTURING AND USING LUBRICANT COMPOSITIONS HAVING ANTIMICROBIAL PROPERTIES

(75) Inventors: Keith D. Lokkesmoe, Savage, MN (US); Joel James Schilling, South St. Paul, MN (US); Robert D. P. Hei, Baldwin, WI (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/935,968

(22) Filed: Aug. 23, 2001

(65) Prior Publication Data

US 2002/0028751 A1 Mar. 7, 2002

Related U.S. Application Data

(63) Continuation of application No. 09/427,806, filed on Oct. 27, 1999, now Pat. No. 6,310,013.

(51) Int. Cl.[7] ..... C10M 125/18; C10M 133/04

(52) U.S. Cl. ..... 508/149; 508/389; 508/421; 508/462; 508/513; 508/547

(58) Field of Search ..... 508/149, 462

(56) References Cited

U.S. PATENT DOCUMENTS

| | | | | |
|---|---|---|---|---|
| 3,583,914 | A | 6/1971 | Garvin et al. | 508/245 |
| 3,700,013 | A | 10/1972 | Coffey et al. | 106/2 |
| 3,826,746 | A | 7/1974 | Schick et al. | 508/266 |
| 3,955,005 | A | 5/1976 | Trelease et al. | 426/310 |
| 4,062,785 | A | 12/1977 | Nibert | 252/49.6 |
| 4,067,997 | A | 1/1978 | Kabara | 424/312 |
| 4,088,585 | A | 5/1978 | Karpen | 508/141 |
| 4,381,293 | A | 4/1983 | Michel | 424/401 |
| 4,537,689 | A | 8/1985 | Morrow et al. | 508/143 |
| 4,648,985 | A | 3/1987 | Thorsell et al. | 508/364 |
| 4,749,503 | A | 6/1988 | Bennett et al. | 252/49.3 |
| 4,837,019 | A | 6/1989 | Georgalas et al. | 424/59 |
| 4,869,839 | A | 9/1989 | Griffin et al. | 508/502 |
| 4,954,338 | A | 9/1990 | Mattox | 514/372 |
| 4,995,997 | A | 2/1991 | Noda et al. | 252/49.5 |
| 5,002,675 | A | 3/1991 | Randisi | 508/219 |
| 5,062,978 | A | 11/1991 | Weber et al. | 508/500 |
| 5,091,174 | A | 2/1992 | Lemberger | 424/75 |
| 5,102,567 | A | 4/1992 | Wolf | 252/46.6 |
| 5,149,536 | A | 9/1992 | Ratkus | 424/401 |
| 5,182,035 | A | 1/1993 | Schmidt et al. | 508/527 |
| 5,232,691 | A | 8/1993 | Lemole | 424/78.02 |
| 5,244,589 | A | 9/1993 | Dirksen et al. | 508/449 |
| 5,326,492 | A | 7/1994 | Hodam, Jr. | 510/383 |
| 5,364,874 | A | 11/1994 | Morpeth | 514/373 |
| 5,372,220 | A | 12/1994 | Jacobs et al. | 184/6.14 |
| 5,462,681 | A | 10/1995 | Gutzmann et la. | 252/11 |
| 5,470,874 | A | 11/1995 | Lerner | 514/474 |
| 5,490,983 | A | 2/1996 | Worley et al. | 424/405 |
| 5,622,708 | A | 4/1997 | Carlson et al. | 424/405 |
| 5,723,418 | A | 3/1998 | Hei et al. | 508/511 |
| 5,772,003 | A | 6/1998 | Hunt | 198/495 |
| 5,863,874 | A | 1/1999 | Hei et al. | 508/521 |
| 5,869,436 | A | 2/1999 | Lindman | 508/174 |
| 5,932,526 | A | 8/1999 | Hei et al. | 508/559 |
| 5,985,804 | A | 11/1999 | Ashjian et al. | 508/287 |
| 6,004,909 | A | 12/1999 | Lindman | 508/174 |
| 6,214,777 | B1 * | 4/2001 | Li et al. | 508/388 |
| 6,310,013 | B1 * | 10/2001 | Lokkesmoe et al. | 508/502 |

FOREIGN PATENT DOCUMENTS

| | | | |
|---|---|---|---|
| AU | A-73074/94 | | 4/1996 |
| AU | 9473074 | A | 4/1996 |
| DE | 19642598 | A | 4/1998 |
| EP | 14238 | | 8/1980 |
| EP | 245928 | A | 11/1987 |
| EP | 283893 | A1 | 9/1988 |
| EP | 530861 | A | 3/1993 |
| EP | 614660 | A1 | 9/1994 |
| EP | 0 735 127 | A1 | 3/1996 |
| JP | 02097593 | A2 | 4/1990 |
| JP | 08151328 | A | 6/1996 |
| JP | 08333592 | A | 12/1996 |
| WO | WO 92/13048 | A1 | 8/1992 |
| WO | WO 92/13050 | A1 | 8/1992 |
| WO | WO 93/18120 | A1 | 9/1993 |
| WO | WO 94/20578 | A1 | 9/1994 |
| WO | WO 95/20319 | | 8/1995 |
| WO | WO 97/45509 | A1 | 12/1997 |
| ZA | 9006002 | A | 6/1991 |

OTHER PUBLICATIONS

Batterson, J. and Entrup, M., "Preservative Efficacy Study", *Whitmore Manufacturing Company,* 4 pgs. (Aug. 2, 1993).

"Bel–Ray Total Performance Lubricants" World Class "Worldwide", *http://belray.com/industrial/industrial.html* 4 pgs. (Printed Jan. 14, 1999).

Brittain, D., Technical Document entitled "Becker"–Lubricating Oils for Becker Dekatorr Pumps—Part 1: Understanding and Selecting, *http://www.beckerpumps.com/tdl.htm.*from *The Edge,* No. 5, 2 pgs. (1995).

"Chemical Preservatives", *Food Microbiology Fundamentals and Frontiers,* edited by Doyle, M. et al., pp. 528–534 (Date unknown).

(List continued on next page.)

*Primary Examiner*—Ellen M. McAvoy
(74) *Attorney, Agent, or Firm*—Merchant & Gould P.C.

(57) ABSTRACT

A lubricant composition is provided. The lubricant composition includes a machinery lubricant and an antimicrobially effective amount of an antimicrobial agent. The antimicrobial agent exhibits a partition coefficient between water and the machinery lubricant of between about 0.01 and about 1,000, and the lubricant composition provides at least a two log reduction in bacteria in water in about two weeks or at least a two log reduction in mold and yeast in water in about one month from a concentration of bacteria of between $10^5$ and $10^6$ CFU/ml and a mold and yeast concentration of between about $10^5$ and $10^6$ CFU/ml. Methods for manufacturing and using a lubricant composition are provided. A method for manufacturing a lubricant composition is provided.

30 Claims, No Drawings

OTHER PUBLICATIONS

"Cleaning and Sanitizing of Plant and Equipment in the Egg Handling and Processing Industry", *Australian Standard,* 35 pp., Abstract only (1987).

Dallyn, H. "Antimicrobial Properties of Vegetable and Fish Oils", *Natural Antimicrobial Systems and Food Preservation, CAB International: Wallingford, Englasd, UK,* Abstract (1994).

Declaration of Joel James Schilling dated Aug. 3, 2000.

Dillon, V.M. et al., "Natural Antimicrobial Systems and Food Preservation", *CAB International: Wallingford, England, UK,* Abstract (1994).

"Food Additives. Sanitizing Solutions", *Federal Register,* pp. 53001–53002, Abstract only (Dec. 3, 1976).

"Food Machinery Lubricants", *Vulcan Ecolab,* 5 pgs. (Date unknown).

"Improved Food Grade Lubricants Contain Antimicrobial Agent", *Source unknown,* 1 pg. (Date unknown).

Straka, A., "Chemicals to use for Cleaning and Sanitizing", *Independent Restaurants,* vol. 48, No. 10, p. 42, Abstract only (Oct. 1986).

Technical Data Sheet entitled Whitmore's–Medallion™ *FM Grease,* 4 pgs. (Printed Jan. 14, 1999).

"Whitmore's Technical Data Sheet—Medallion™ Food Machinery Grease", *http://www.whitemore.com/Tech-DataSh...edFMGrease.htm*, 4 pgs., (Printed Jan. 14, 1999).

* cited by examiner

LUBRICANT COMPOSITIONS HAVING ANTIMICROBIAL PROPERTIES AND METHODS FOR MANUFACTURING AND USING LUBRICANT COMPOSITIONS HAVING ANTIMICROBIAL PROPERTIES

This application is a continuation of U.S. application Ser. No. 09/427,806, filed Oct. 27, 1999 and now U.S. Pat. No. 6,310,013. U.S. application Ser. No. 09/427,806 is incorporated herein by reference.

FIELD OF THE INVENTION

The invention relates to lubricant compositions having antimicrobial properties and to methods for manufacturing and using lubricant compositions having antimicrobial properties. The lubricant compositions are particularly useful for lubricating food handling/processing machinery commonly used in the food processing industry.

BACKGROUND OF THE INVENTION

Oil-based lubricants are commonly used in the food processing industry in order to provide lubrication in gear boxes, pumps, hydraulic systems, agitators, grinders, etc. Although the lubricant is often provided inside a piece of machinery which is generally isolated from the exterior environment, food processing equipment is often cleaned using a high pressure water stream. Over time, water from cleaning operations tends to make its way into the machinery and contact the lubricant, forming a water and oil emulsion. Such water and oil emulsions become fertile grounds for growth of bacteria, yeast, and molds.

A food grade lubricant is available under the name No-Tox® from Bel-Ray Company, Inc. The lubricant incorporates an antimicrobial agent. Another lubricant containing a bacteriostatic agent is available under the name Lubristat® from Whitmore Mfg., Inc.

Lubricants containing antimicrobial agents are disclosed U.S. Pat. No. 3,826,746 to Schiek, et al. In general, Schiek, et al. describes lubricant compositions, such as, petroleum lubricant compositions, containing biocidal agents as microbial inhibitors. The biocidal agents include a substituted nitropyridine and an acid. In general, the concern is that bacteria may metabolize the hydrocarbons and result in the formation of deleterious metabolites.

SUMMARY OF THE INVENTION

A lubricant composition is provided by the invention. The lubricant composition includes a machinery lubricant and an antimicrobially effective amount of an antimicrobial agent exhibiting a partition coefficient between water and the machinery lubricant of between about 0.01 and about 1,000. The partition coefficient is the ratio of the weight fraction of the antimicrobial agent in water relative to the weight fraction of the antimicrobial agent in oil, wherein the ratio is determined at equilibrium. In addition, the lubricant composition exhibits at least a two log reduction of bacteria in water in about two weeks and/or at least a two log reduction of mold and yeast in water in about one month from a concentration of bacteria of between $10^5$ and $10^6$ CFU/ml (colony forming units/ml) and a mold and yeast concentration of between $10^5$ and $10^6$ CFU/ml.

A method for manufacturing a lubricant composition is provided by the invention. The method includes a step of mixing machinery lubricant and an antimicrobially effective amount of an antimicrobial agent exhibiting a partition coefficient between water and the machinery lubricant of about 0.01 and about 1,000.

A method for using a lubricant composition in machinery is provided by the invention. The method includes a step of introducing a lubricant composition containing a machinery lubricant and an effective amount of an antimicrobial agent, into machinery to provide lubrication properties. Exemplary machinery includes gear boxes, pumps, hydraulic systems, agitators, and grinders. The lubricant composition can be used in environments where microbial contamination is a concern. Exemplary environments include food processing equipment, pharmaceutical processing equipment and cosmetic processing equipment.

DETAILED DESCRIPTION OF THE PREFERRED EMBODIMENT

The invention relates to a lubricant composition containing a machinery lubricant and an antimicrobially effective amount of an antimicrobial agent. Machinery lubricants are commonly available. Machinery lubricants which can be used according to the invention include petroleum derived lubricants. A preferred type of machinery lubricant which can be used to provide the lubricant composition according to the invention is a food machinery lubricant. In general, food machinery lubricants include those lubricants which can be used on food processing machinery in the food processing industry where there is a possibility of incidental contact with food. In general, such lubricants do not include large amounts of impurities harmful to humans. Lubricants which can be used on food processing equipment include FDA-approved food grade lubricants. Machinery lubricants can include oils and/or greases.

Various food grade oils and greases are commercially available. In general, types of food grade oils which can be used according to the invention include paraffinic oils, synthetic polyalpha olefin oils, aluminum complex grease, and mineral oil. Exemplary food machinery lubricants which can be used according to the invention are available from Vulcan Oil and Chemical Products of Cincinnati, Ohio under the names Ariadne™, Athena™, Bacchus™, Hercules™, Olympus™, Posseidon™, Zeus™, Prestige™, and Ep Grease™.

The antimicrobial agents which can be incorporated into the machinery lubricants to provide an antimicrobial effect include those antimicrobial agents which function to kill bacteria and/or yeast and mold which may exist in the machinery lubricant or become introduced into the machinery lubricant. Preferred antimicrobial agents include those which can be accepted for use on machinery in the food processing industry. In general, antimicrobial agents which are considered toxic to humans at levels needed to provide antimicrobial effect are not preferred antimicrobial agents for use in the food processing industry. Additional industries in which it is desirable to provide a machinery lubricant containing an antimicrobially effective amount of an antimicrobial agent include pharmaceutical processing and cosmetic processing.

The antimicrobial agents which can be incorporated into the machinery lubricants according to the invention are those exhibiting a distribution coefficient between water and the machinery lubricant which is sufficient to allow it to function as an antimicrobial agent over the life of the lubricant composition on a particular piece of machinery. The applicants discovered the desirability of providing an antimicrobial agent which exhibits solubility in both oil and water phases. As a result, when water is introduced into the lubricant composition, a portion of the antimicrobial agent provided in the oil phase becomes solubilized in the water phase. If the solubility of the antimicrobial agent in the oil phase is too high relative to its solubility in the water phase, a sufficient amount of antimicrobial agent to kill microbes in the water phase may not move into the water phase. In addition, if the antimicrobial agent is too water soluble relative to its oil solubility, too much antimicrobial agent may move into the water phase depleting the oil phase of antimicrobial agent and thereby reducing the longevity or life of the lubricant composition as an antimicrobial composition. That is, the lubricant composition may lose its effectiveness as an antimicrobial composition too quickly. A property which reflects the competitive solubility between the oil phase and the water phase can be referred to as the distribution coefficient. The distribution coefficient is generally expressed as a ratio of the weight fraction of the antimicrobial agent in water relative to the weight fraction of the antimicrobial agent in oil, wherein the ratio is determined at equilibrium. Preferably, the distribution coefficient for an antimicrobial agent in a lubricant composition is between about 0.01 and about 1,000. It is pointed out that a high distribution coefficient of about 1,000 may be considered acceptable if there is very little water contacting the lubricant composition and/or if the lubricant composition is replaced fairly frequently. A preferred distribution coefficient is between about 0.1 and about 100, more preferably between about 0.2 and about 50, and more preferably between about 0.5 and 20. In general, the distribution coefficient can be determined by varying the amounts of oil, water, and antimicrobial agent and running a regression of the data. The water, oil, and antimicrobial agent composition is preferably agitated and allowed to phase separate. Once an equilibrium is reached, the amount of antimicrobial agent in the water phase or oil phase or both can be measured. A technique for measuring the weight percent of an antimicrobial agent in water includes high performance liquid chromatography (HPLC).

Exemplary classes of antimicrobial agents which can be used according to the invention include substituted phenolics, polyhalides, interhalides, iodophores, percarboxylic acids, carboxylic acids, quaternary compounds and mixtures thereof. The antimicrobial agents can be provided in the lubricant composition at a concentration of between about 0.001 wt. % and about 10 wt. %.

Substituted phenolic antimicrobial agents includes esters of parahydroxy benzoic acids. Preferred esters of parahydroxy benzoic acid include alkyl esters of parahydroxy benzoic acid. Preferred alkyl groups include $C_1$ to $C_8$ alkyl groups, and more preferably $C_1$ to $C_4$ alkyl groups. Preferred esters of parahydroxy benzoic acid include the methyl, ethyl, propyl, and butyl esters. Preferred antimicrobial agents of this type are available under the name paraben. A preferred paraben compound includes methyl paraben (methyl 4-hydroxybenzoate). Esters of parahydroxy benzoic acid can include those esters of parahydroxy benzoic acid other than methyl paraben. Additional paraben compounds which can be used include ethyl paraben, propyl paraben, and butyl paraben. In general, the esters of parahydroxy benzoic acid are provided in an amount to provide an antimicrobial effect. In general, this corresponds with an amount of at least about 100 ppm based on the weight of the lubricant composition. Preferably, the amount is between about 500 ppm and about 5,000 ppm based on the weight of the lubricant composition.

Additional substituted phenolic antimicrobial agents include hydroxy anisole compounds, hydroquinone compounds, and hydroxytoluene compounds. A preferred hydroxy anisole compound is 2-butylated hydroxy anisole (BHA). A preferred hydroquinone compound is tertiary butylhydroquinone (TBHQ). A preferred hydroxytoluene compound is butylated hydroxytoluene (BHT). The hydroxy anisole compounds, hydroquinone compounds, and hydroxytoluene compounds are preferably used in an amount of between about 500 ppm and about 2,000 ppm based on the weight of the lubricant composition Polyhalide antimicrobial agents which can be used according to the invention include substituted ammonium. Preferred polyhalides have the following formula:

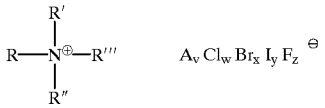

wherein R, R', R", and R'" may be the same or different and independently are a straight or branched, unsaturated or saturated, hydrocarbon group of 1 to 24 carbon atoms, in which the hydrocarbon chain is unsubstituted or substituted by hydroxyl, carboxyl, or alkylamido, or in which the hydrocarbon chain is uninterrupted or interrupted by a heteroatom; an aryl group, or aralkyl group in which alkyl has 1 to 4 carbon atoms. A is a counter ion which may be, for example, sulfate, methyl sulfate, and acetate. V is 0 to 1, W is 0 to 4, X is 0 to 7, Y is 0 to 9, and Z is 0 to 1 wherein V+W+X+Y+Z is at least 2, and more preferably wherein W+X+Y+Z is at least 2. Preferably, Y is 1 to 5.

Preferred quaternary nitrogen compounds that can be used to prepare polyhalides include quaternary ammonium compounds having the formula:

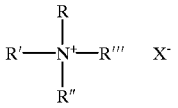

(I)

wherein X is an anion except a hydroperoxide anion and R, R', R" and R'" are each independently a straight or branched, unsaturated or saturated, hydrocarbon group of 1 to 24 carbon atoms, in which the hydrocarbon chain is unsubstituted or substituted by hydroxyl, carboxyl, or alkylamido, or in which the hydrocarbon chain is uninterrupted or interrupted by a heteroatom; an aryl group, or aralkyl group in which alkyl has 1 to 4 carbon atoms. One embodiment of the formula I includes a compound where R' is benzyl and R" is aryl or benzyl.

An alkyl group is defmed as a paraffmic hydrocarbon group which is derived from an alkane by removing one hydrogen from the formula. The hydrocarbon group may be linear or branched. Simple examples include methyl ($CH_3$) and ethyl ($C_2H_5$). However, in the present invention, at least one alkyl group may be medium or long chain having, for example, 8 to 16 carbon atoms, preferably 12 to 16 carbon atoms.

An alkylamido group is defined as an alkyl group containing an amide functional group: —$CONH_2$, —CONHR, —CONRR'.

A heteroatom is defined as a non-carbon atom which interrupts a carbon chain. Typical heteroatoms include nitrogen, oxygen, phosphorus, and sulfur.

An aryl group is defined as a phenyl, benzyl, or naphthyl group containing 6 to 14 carbon atoms and in which the aromatic ring on the phenyl, benzyl or naphthyl group may be substituted with a $C_1$–$C_3$ alkyl. An aralkyl group is aryl having an alkyl group of 1 to 4 carbon atoms.

Certain quaternary nitrogen compounds are especially preferred. These include alkyl trimethyl ammonium salts, dialkyl dimethyl ammonium salts, alkyl dimethyl piperidinium salts, and alkyl dimethyl pyridinium salts.

Several preferred compounds are shown below. The first structure shown is cetyl trimethyl ammonium chloride; the second structure is didecyl dimethyl ammonium chloride; and the third is choline chloride. Another source of choline is available from phosphatidyl choline which is commercially available in lecithins.

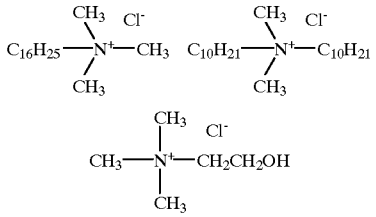

In each structure, the ammonium nitrogen is seen as covalently bonded to four substituents and ionically bonded to a chlorine anion.

The nitrogen compound can also be a protonated amine of the formula:

(II)

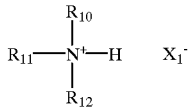

wherein $X_1$ is an anion; and $R_{10}$, $R_{11}$ and $R_{12}$ are each, independently, hydrogen or at least one straight or branched, saturated or unsaturated, hydrocarbon group of 1 to 24 carbon atoms, in which the hydrocarbon chain is unsubstituted or substituted by hydroxyl, carboxyl, or alkylamido, or in which the hydrocarbon chain is uninterrupted or interrupted by a heteroatom; an aryl group, or aralkyl group in which alkyl has 1 to 4 carbon atoms.

In the invention, the quaternary ammonium cation can also be generated from an amphoteric molecule. An amphoteric compound can function as either an acid or as a base, depending on its environment, and has both functional groups present. A representative structure of the cation generated from an amphoteric molecule is shown below:

(III)

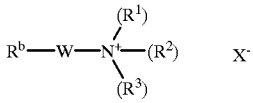

wherein W is a linear or branched alkylene, hydroxyalkylene or alkoxyalkylene group having 1–6 carbon atoms;

$R^b$ is $R^4$—CO—NH in which $R^4$ is a saturated or unsaturated, branched or linear hydrocarbon group having 4–22 carbon atoms, or $R^4$;

$R^1$ is hydrogen, A or $(A)_n$—W—$CO_2^-M^+$ in which A is a linear or branched alkyl, hydroxyalkyl or alkoxyalkyl having 1–4 carbon atoms, n is an integer from 0 to 6, and M is an alkali metal cation, a hydrogen ion or an ammonium cation;

$R^2$ is $(A)_n$—W—$CO_2^-M^+$;

$R^3$ is hydrogen or A; and

X is an anion.

An example of a suitable amphoteric is shown below:

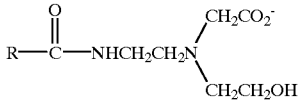

where R is hydrogen, straight or branched alkyl having 1 to 16 carbon atoms, in which the alkyl group is uninterrupted or interrupted by phenyl. This is not itself a quaternary ammonium compound. Treatment with an organic or inorganic acid $H^+X^-$ can result in a compound of the formula:

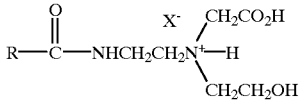

where $X^-$ is an anion. This does indeed represent a quaternary ammonium compound which can be mixed with an appropriate oxidant and halogen, or halide salt, to meet the claimed invention, wherein.

Another class of amphoteric compounds can include the phosphorus containing species such as phospholipids like the lecithins (including phosphatidyl choline.), sphingomyelin, and the cephalins. Or modified phosphoamphoterics such as the Phosphoterics®, sold by Mona Industries.

The invention can also use protonizable nitrogen sources. Examples include proteins, amino acids, amine oxides and amines which can form acid salts and mixtures thereof. These include, for example, sarcosine, taurine, glycine, and simple proteins such as albumins, phosphoproteins, protamines, histones, chromoproteins, schleroproteins, glutenins and globulins. Examples of protonizable proteins include milk, egg, blood and plant proteins. The nitrogen compound can be a protein, an acid salt thereof, or a mixture of proteins and their corresponding acid salts. Generally, these can be characterized as:

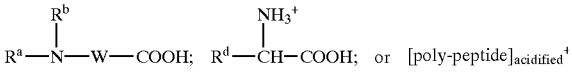

wherein $R^a$ is a linear or branched, saturated or unsaturated, hydrocarbon, hydroxyalkyl or alkoxyalkyl group having 1–22 carbon atoms; $R^b$ is H or $CH_3$, and W is a linear or branched alkylene, hydroxyalkylene or alkoxyalkylene group having 1–4 carbon atoms.

$R^d$ is a common moiety as part of natural amino acids; e.g., H, alkyl, hydroxyalkyl, thioalkyl, alkyl-aryl, carboxyl, amido, alkyl-amino, and the like.

$[\text{poly-peptide}]_{acidified}^+$ refers to an acidified polypeptide, such as an acidified protein.

Additional preferred quaternary nitrogen sources include a choline, particularly a choline chloride, a choline bitartrate, an acetyl choline; or mixtures thereof. An additional preferred compound is cetyl dimethyl pyridinium chloride. The nitrogen source may also include mixtures thereof.

The nitrogen compound can also be a betaine, sultaine or phosphobetaine of the formula (IV)

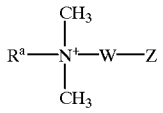

wherein Z is $CO_2H$, $CO_2^-$, $SO_3H$, $SO_3^-$, $OSO_3H$, $OSO_3^-$, $OPO_3H$ or $OPO_3^-$; W is a linear or branched alkylene, hydroxyalkylene or alkoxyalkylene group having 1–6 carbon atoms; and $R^a$ is a linear or branched alkyl, hydroxyalkyl or alkoxyalkyl group having 1–22 carbon atoms; or $R^4$—CO—NH$(CH_2)_x$, in which $R^4$ is a saturated or unsaturated, branched or linear hydrocarbon group having 4–22 carbon atoms, and x' is an alkylene group having 1–6 carbon atoms.

A suitable betaine cation is shown below:

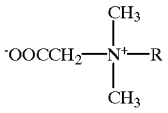

wherein; R is a linear or branched alkyl, hydroxyalkyl or alkoxyalkyl group having 1–22 carbon atoms; or $R^4$—CO—NH$(CH)_x$ in which $R^4$ is a saturated or unsaturated, branched or linear hydrocarbon group having 4–22 carbon atoms, and x is an alkylene group having 1–6 carbon atoms. Of special interest is the natural product betaine where R has 1 carbon atom.

In another embodiment, the nitrogen compound can be of the formula:

(VI)

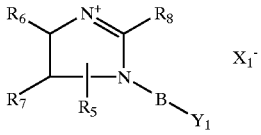

wherein $R_6$, $R_7$ and $R_8$ are each, independently, H or —$A_1$—Y in which $A_1$ is a $C_7$ to $C_{20}$ saturated or unsaturated, linear or branched alkylene group, and Y is H, $NH_2$, OH or $COOM_1$ in which $M_1$ is H or a Group I metal ion;

B is a $C_1$ to $C_{20}$ saturated or unsaturated, linear or branched chain alkylene group, and $Y_1$ is H, $NH_2$, OH, $COOM_2$ or —NH—$COR_q$ in which $M_2$ is H or a Group I metal ion and $R_q$ is a $C_1$ to $C_{20}$ saturated or unsaturated, linear or branched chain alkyl group;

$R_5$ is H or a $C_1$ to $C_3$ alkyl group at one of the nitrogen atoms; and $X_1^-$ is an anion.

Typical imidazolines are: coconut hydroxyethyl imidazoline, tall oil aminoethyl imidazoline, oleyl hydroxyethyl imidazoline, the Miramines®, the Rhodaquats®, the Monazolines®, the Rewoterics®, the Crodazoline®, available from Mona Industries Inc., Rhone Poulenc, Rewo Chemische Werke GmbH, and Croda Surfactants Ltd.

Exemplary quaternary ammonium compounds include those described in U.S. application Ser. No. 09/277,592, filed Mar. 26, 1999, the entire disclosure of which is incorporated herein by reference.

The amount of polyhalide antimicrobial agent provided in the lubricant composition is preferably at least about 10 ppm based on the weight of the lubricant composition. In general, the amount of polyhalide antimicrobial agent provided in the lubricant composition is less than about 10,000 ppm or 1 wt. %.

Interhalides which can be used as antimicrobial agents according to the invention include iodine monochloride (ICl) and iodine dichloride ($ICl_2^-$). Interhalides are generally useful as antimicrobial agents in the lubricant composition at a concentration of at least about 10 ppm. Preferably, the amount of interhalide is provided at less than about 10,000 ppm or 1 wt. %.

Iodophores which can be used as antimicrobial agents according to the invention include iodine complexes of nonionic surfactants and iodine complexes of polyvinylpyrrolidone. In addition, molecular iodine can be used as an antimicrobial agent. Iodophores and/or molecular iodine are preferably provided at a concentration of at least about 10 ppm, and preferably at a concentration of between about 10 ppm and about 10,000 ppm or 1 wt. %.

Percarboxylic acid antimicrobial agents which can be used according to the invention include $C_2$ to $C_{18}$ percarboxylic acids including peracetic acid, peroctanoic acid, pemonanoic acid, and perdecanoic acid. In addition, dipercarboxylic acids can be used such as persuccinic acid, perglutaric acid, permaleic acid, perfumaric acid, peradiptic acid, and mixtures thereof. In general, the amount of peracid antimicrobial agent is preferably between about 10 ppm and about 10,000 ppm based on the weight of the lubricant composition.

Carboxylic acids which can be used as antimicrobial agents according to the invention include $C_1$ to $C_{11}$ aliphatic and aromatic carboxylic acids and/or the salts of $C_1$ to $C_{11}$ aliphatic and aromatic carboxylic acids. Preferred carboxylic acids include butyric acid, heptanoic acid, octanoic acid, nonanoic acid, decanoic acid, benzoic acid, sorbic acid, salicic acid, ethyl-hexanoic acid, lactic acid, and mixtures thereof. The carboxylic acids are preferably provided at a concentration of at least about 10 ppm, and more preferably between about 10 ppm and about 10,000 ppm or 1 wt. %.

Quaternary compounds which can be used as antimicrobial agents according to the invention include quaternary ammonium and quaternary phosphonium compounds. Preferably, the concentration of quaternary compounds provided in the lubricant composition is at least about 100 ppm. Preferably, the concentration of quaternary compounds in the lubricant composition is less than about 5,000 ppm.

Preferred quaternary ammonium compounds include dioctyldimethyl ammonium chloride, didecyl dimethyl ammonium chloride, octyldecyl dimethyl ammonium chloride, tetramethyl ammonium chloride, alkyl dimethyl benzyl ammonium chloride (preferably, the alkyl group contains between about $C_6$ to about $C_{18}$ carbon atoms), didodecyldimethyl ammonium chloride, cetyltrimethyl ammonium bromide, benzyloctadecyldimethyl ammonium chloride, and dodecyldimethyl (2-phenoxyethyl) ammonium bromide.

Further exemplary quaternary ammonium compounds include benzalkonium chlorides, substituted benzalkonium chlorides, cetylpyridinium chloride, N-(3-chloroallyl) hexaminium chloride, domiphen bromide, benzethonium chloride, and methylbenzethonium chloride. Monoalkyltrimethyl ammonium salts include cetyltrimethyl ammonium bromide, alkyltrimethyl ammonium chloride, alkylaryltrimethyl ammonium chloride, and cetyl-dimethyl ethyl ammonium bromide. Exemplary monoalkyldimethylbenzyl ammonium salts include alkyldimethylbenzyl ammonium chlorides such as those sold under the names BTC 824, Hyamine 3500, Cyncal Type 14, and Catigene. Additionally included are substituted benzyl quaternary ammonium compounds including dodecyldimethyl-3, 4-dichlorobenzyl ammonium chloride such as that sold under the name Riseptin. Additionally included are mixtures of alkyldimethylbenzyl and alkyldimethyl substituted benzyl (ethylbenzyl) ammonium chlorides such as BTC 2125M, Barquat 4250. Dialkyldimethyl ammonium salts include didecyldimethyl ammonium halides such as those available as Deciquam 222 and Bardac 22, and octyldecyldimethyl ammonium chloride such as those available under the name DTC 812. Heteroaromatic ammonium salts include cetylpyridinium halide, the reaction product of hexamethylenetetramine with 1, 3-dichloropropene to provide cis-isomer 1-(3-chloroallyl)-3, 5, 7-triaza-1-azoniaadamantane, alkylisoquinolinium bromide, and alkyldimethyl-naphthylmethyl ammonium chloride. Poly substituted quaternary ammonium salts include alkyldimethylbenzyl ammonium saccarinate and methylethylbenzyl ammonium cyclohexylsulfamate. Bis-quatemary ammonium salts include 1, 10-bis(2-methyl-4-aminoquinolinium chloride)-decane and 1, 6-bis (1-methyl-3-(2, 2, 6-trimethyl cyclohexyl)-propyldimethyl ammonium chloride) hexane. Additionally included are polymeric quaternary ammonium compounds including those available under the names WSCP, Mirapol-A15, and Onamer M.

Exemplary quaternary phosphonium compounds include ethyltriphenyl phosphonium bromide, butyltriphenyl phosphonium chloride, methyltriphenyl phosphonium bromide, tetraphenyl phosphonium bromide, ethyltriphenyl phosphonium acetate, ethyltriphenyl phosphonium iodide, benzyltriphenyl phosphonium chloride, (ethoxycarbonylmethylene) triphenyl phosphorane, (ethoxycarbonylmethyl) triphenyl phosphonium bromide, (ethoxycarbonylmethyl) triphenyl phosphonium chloride, (formylmethylene) triphenyl phosphorane, (2-hydroxybenzoyl) methylenetriphenyl phosphorane, (2-hydroxyethyl) triphenyl phosphonium bromide, (2-hydroxyethyl) triphenyl phosphonium chloride, (methoxycarbonylmethyl) triphenyl phosphonium bromide, and (methoxycarbonylmethyl) triphenyl phosphonium chloride. A preferred quaternary compound includes tetrakishydroxymethyl phosphonium sulfate.

It should be appreciated that the above-identified quaternary compounds can be provided with other anions than those mentioned. Exemplary anions include chloride, sulfate, bromide, acetate, iodide, methyl ethyl sulfate.

The amount of antimicrobial agent is preferably provided in an amount that will reduce a bacterial concentration in the lubricant composition from greater than $10^5$ (between $10^5$ and $10^6$) to less than 10 CFU/ml (colony forming units/ml) after two weeks. In the case of yeast and mold counts, the antimicrobial agents will preferably provide a reduction from an initial concentration of greater than $10^5$ (between $10^5$ and $10^6$) to less than 10 CFU/ml within about one month. Another way of expressing a desired performance of the lubricant composition according to the invention is that it will preferably provide a two log reduction of bacteria in water in about two weeks, and a two log reduction of mold and yeast in water in about one month. Preferably, the lubricant composition will provide a four log in bacteria in about two weeks, and a four log reduction in mold and yeast in about one month. Most preferably, the lubricant composition will provide a five to six log reduction of bacteria in about two weeks, and a five to six log reduction in mold and yeast in about one month. Exemplary bacteria which can be reduced include *Staphylococcus aureus, Escherichia coli, Enterobacter aerogenes*, and *Pseudomonas aeruginosa*. Exemplary yeast and mold which can be reduced include *Candida albicans, Saccharomyces cerevisiae*, and *Aspergillus niger.*

It is desirable for the antimicrobial agent to exhibit a distribution coefficient between water and oil phases of between about 0.1 and about 100. It is generally understood that the bacteria, yeast, or mold tends to grow in the water phase. That is, as water seeps into machinery including, for example, gear boxes, pumps, hydraulic systems, agitators, grinders, etc., bacteria, yeast, and/or mold may begin growing in the water phase. Accordingly, it is desirable for the antimicrobial agent to migrate from the oil phase into the water phase in order to kill the bacteria, yeast, or mold. The applicants discovered that by incorporating an microbial agent which is soluble in both oil and water into a lubricant composition, it is possible to kill the bacteria, yeast, or mold that tends to grow in the water phase. Furthermore, it is desirable to provide the antimicrobial agent so that it does not all transfer into the water phase. That is, it is desirable for the antimicrobial agent to partition between the oil phase and the water phase. This partitioning increases the longevity of the lubricant composition for killing bacteria, yeast, and mold. Preferably, the partition coefficient of the antimicrobial agent is preferably greater than 0.2 and more preferably greater than 0.5, and preferably less than 50 and more preferably less than 20.

EXAMPLE 1

Four food grade lubricants available from Vulcan Oil and Chemical Products were tested with and without added antimicrobial agents to evaluate effectiveness at killing bacteria and yeast and mold. The evaluation was conducted using United States Pharmacopeia XXIV, Chapter 51, Antimicrobial Preservation Effectiveness Method. The four food grade lubricants are identified by the names Bacchus™, Hercules™, Poseidon™ and Athena™. The antimicrobial agents identified in Table 1 are mixed into the identified oil in the weight % indicated.

An aqueous inocula was prepared and added to the oil samples at 5 wt. % to mimic possible accidental addition of water into oil which sometimes may occur at a food processing plants. The inoculum were prepared as follows:

Bacterial inocula:

*Staphylococcus aureus* ATCC 6538
*Escherichia coli* ATCC 11229
*Enterobacter aerogenes* ATCC 13048
*Pseudomonas aeruginosa* ATCC 15442

The aqueous inoculum was prepared by mixing 12.5 mL of each bacterial broth culture together, then adding the 60 mL of mixed culture to 540 mL phosphate buffered dilution water.

Yeast and Mold Inocula:

*Candida albicans* ATCC 18804
*Saccharomyces cerevisiae* ATCC 834
*Aspergillus niger* ATCC 16404

The inoculum was prepared by mixing 20 mL of each yeast and 20mL of the mold culture together, then adding the 60 mL of mixed culture to 540 mL of phosphate buffered dilution water.

Inoculum numbers reported are actual CFU/mL. A calculation was done to determine the microbial level once the inocula were in the test formulations.

Each oil sample was inoculated with 5 wt. % inocula, shaken briskly and allowed to sit for 24 hours before sampling. There was a distinct water/oil separation. A 1-mL sample was taken from the aqueous phase. The inoculated sample included 475 mL lubricant composition and 25 mL inoculant.

A standard plate count was performed on each test substance before inoculation, and a standard plate count was also performed on days 0, 7, 14, 21 and 28 (the first day being considered day 0) after inoculation. Test suspensions were shaken vigorously each working day between platings except the day before plating where solutions were allowed to phase separate. On the day of sampling, a 1 mL sample was pulled out of each phase for evaluation.

The results of this experiment are reported in Table 1.

TABLE 1

| | | LOG OF CFU | | | | | | | | | |
|---|---|---|---|---|---|---|---|---|---|---|---|
| | Antimicrobial Agent | Bacteria (week #) | | | | | Yeast and mold (week #) | | | | |
| Oil Sample | (wt. %) | 0 | 1 | 2 | 3 | 4 | 0 | 1 | 2 | 3 | 4 |
| Bacchus | none | 6 | 0 | 0 | 0 | 0 | 5 | 4 | 2 | 2 | 2 |
| Bacchus | 0.2 methyl paraben | 6 | 0 | 0 | 0 | | 6 | 0 | 0 | 0 | 0 |
| Bacchus | 0.2 propyl paraben | 6 | 0 | 0 | 0 | | 5 | 0 | 0 | 0 | 0 |
| Bacchus | 0.1 methyl paraben and 0.1 propyl paraben | 6 | 0 | 0 | 0 | | 5 | 0 | 0 | 0 | 0 |
| Hercules | none | 6 | 0 | 0 | 0 | 0 | 5 | 0 | 1 | 1 | 0 |
| Hercules | 0.1 methyl paraben | 6 | 0 | 0 | 0 | | 5 | 0 | 0 | 0 | 0 |
| Hercules | 0.1 propyl paraben | 6 | 0 | 0 | 0 | | 5 | 0 | 0 | 0 | 0 |
| Hercules | 0.05 methyl paraben and 0.05 propyl paraben | 6 | 0 | 0 | 0 | | 5 | 0 | 0 | 0 | 0 |
| Poseidon | none | 6 | 4 | 2 | 0 | | 5 | 4 | 4 | 2 | 2 |
| Poseidon | 0.05 methyl paraben | 6 | 0 | 0 | 0 | | 5 | 0 | 0 | 0 | 0 |
| Poseidon | 0.05 propyl paraben | 6 | 6 | 6 | 5 | | 5 | 2 | 2 | 1 | 2 |
| Poseidon | 0.025 methyl paraben and 0.025 propyl paraben | 6 | 5 | 5 | 5 | 4 | 5 | 2 | — | — | — |
| Athena | none | 6 | 4 | 0 | 0 | 0 | 5 | 5 | 4 | 4 | 4 |
| Athena | 0.05 methyl paraben | 6 | 0 | 0 | 0 | | 5 | 3 | 0 | 0 | 0 |
| Athena | 0.05 propyl paraben | 6 | 6 | 6 | 6 | | 5 | 2 | 0 | 0 | 0 |
| Athena | 0.025 methyl paraben and 0.025 propyl paraben | 6 | 6 | 6 | 6 | | 5 | 1 | 0 | 0 | 0 |
| Whitmore Gear Oil | as provided (Lubristat ® ) | 6 | 5 | 5 | 5 | 4 | 5 | 4 | 3 | 4 | 3 |

EXAMPLE 2

Several lubricants available from Vulcan Oil and Chemical Products under the names Athena, Bacchus, Hercules and Poseidon were combined with several antimicrobial agents including butylated hydroxyanisole (BHA), 2,6-di-tert-butyl-4-methylphenol (butylated hydroxytoluene (BHT)), methyl paraben, tert-butylhydroquinone (TBHQ), and choline triiodide. The amount of antimicrobial agent incorporated into each tested lubricant is reported in the following tables.

Inocula was prepared as described in Example 1. Inocula was added to each lubricant containing antimicrobial agent in an amount of 5% of the total volume.

A standard plate count was performed on each test substance before inoculation, and a standard plate count was also performed on days 4, 7, 14, 21 and 28 (the first day being considered day 0) after inoculation. One miL samples were taken from the oil layer of each test substance, then 1-mL samples were taken from the aqueous layer with a syringe. Test suspensions were shaken vigorously each working day between platings, except the day before plating. The results of this experiment are reported in the following tables:

TABLE 2

| | Athena with 0.05% BHA Plate Counts (CFU/mL) | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | $4.0 \times 10^7$* | <10 | $2.5 \times 10^5$ | $7.4 \times 10^2$ |
| Day 7 | $3.9 \times 10^7$* | $1.4 \times 10^5$* | $4.4 \times 10^4$ | $1.4 \times 10^4$ |
| Day 14 | $1.8 \times 10^7$ | $3.0 \times 10^5$ | $2.9 \times 10^4$(y & m) | $3.0 \times 10^3$(y & m) |

TABLE 2-continued

| Athena with 0.05% BHA Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 21 | $1.2 \times 10^7$ | <10 | $1.5 \times 10^4$(mold) | $8.8 \times 10^2$(mold) |
| Day 28 | $1.8 \times 10^7$ | $7.6 \times 10^4$* ** | $2.2 \times 10^4$(mold) | $5.4 \times 10^2$(mold) |

*estimated count
**confirmed by re-test

TABLE 3

| Athena with 0.05% BHT Plate Counts (CFU/mL) | | | | |
|---|---|---|---|---|
| | Pre-inoculation Initial Count Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | 3.5 33 $10^7$ | $<5.5 \times 10^1$ | $4.0 \times 10^4$(y & m) | $6.5 \times 10^2$(mold) |
| Day 7 | $3.2 \times 10^7$ | $5.3 \times 10^5$ | $2.6 \times 10^4$(y & m) | $1.7 \times 10^4$(y & m) |
| Day 14 | $1.5 \times 10^7$ | $3.1 \times 10^5$ | $1.7 \times 10^4$(y & m) | $3.0 \times 10^3$(y & m) |
| Day 21 | $1.9 \times 10^7$ | <10 | $4.1 \times 10^4$(y & m) | $1.0 \times 10^3$(y & m) |
| Day 28 | $1.5 \times 10^7$ | $6.6 \times 10^4$* ** | $4.0 \times 10^4$(y & m) | $1.2 \times 10^3$(y & m) |

*estimated count
**confirmed by re-test

TABLE 4

| Athena with 0.05% Methyl Paraben Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | <10 | <10 | $5.4 \times 10^2$(y & m) | <10 |
| Day 7 | <10 | <10 | <10 | <10 |
| Day 14 | <10 | <10 | <10 | <10 |
| Day 21 | <10 | <10 | <10 | <10 |

TABLE 4-continued

| Athena with 0.05% Methyl Paraben Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 28 | <10 | <10 | <10 | <10 |

TABLE 5

| Athena with 0.05% TBHQ Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | $2.4 \times 10^6$ | <10 | $2.0 \times 10^5$(y & m) | $2.5 \times 10^3$ (mold) |
| Day 7 | $5.4 \times 10^2$ | <10 | $3.0 \times 10^5$(mold) | $4.0 \times 10^3$(mold) |
| Day 14 | <10 | <10 | $4.4 \times 10^4$(y & m) | $5.0 \times 10^2$(mold) |
| Day 21 | <10 | <10 | $6.4 \times 10^4$(mold) | $7.7 \times 10^2$(mold) |
| Day 28 | <10 | <10 | $3.2 \times 10^4$(mold) | $3.0 \times 10^2$(mold) |

TABLE 6

| Bacchus with 0.05% BHA Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | <10 | <10 | $1.4 \times 10^4$(mold) | $2.5 \times 10^3$(mold) |
| Day 7 | <10 | <10 | $2.5 \times 10^4$(mold) | $4.0 \times 10^3$(mold) |
| Day 14 | <10 | <10 | $1.2 \times 10^4$(y & m) | $5.0 \times 10^2$(mold) |
| Day 21 | <10 | <10 | $6.0 \times 10^3$(mold) | $7.7 \times 10^2$(mold) |
| Day 28 | <10 | <10 | $3.0 \times 10^2$(mold) | $3.0 \times 10^2$(mold) |

TABLE 7

| Bacchus with 0.05% BHT Plate Counts (CFU/mL)g | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | <10 | <10 | $1.2 \times 10^3$(y & m) | $5.0 \times 10^3$(mold) |
| Day 7 | <10 | <10 | $9.5 \times 10^3$(mold) | $1.8 \times 10^4$(mold) |
| Day 14 | <10 | <10 | $1.3 \times 10^4$(y & m) | $4.9 \times 10^2$(mold) |
| Day 21 | <10 | <10 | $5.4 \times 10^2$(mold) | $5.3 \times 10^2$(mold) |
| Day 28 | <10 | <10 | $4.2 \times 10^2$(mold) | $2.3 \times 10^2$(mold) |

TABLE 8

| Bacchus with 0.05% Methyl Paraben Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | <10 | <10 | $4.0 \times 10^3$(mold) | $1.4 \times 10^3$(mold) |
| Day 7 | <10 | <10 | $7.8 \times 10^2$(mold) | $8.6 \times 10^2$(mold) |
| Day 14 | <10 | <10 | $3.1 \times 10^2$(y & m) | $1.4 \times 10^2$(mold) |
| Day 21 | <10 | <10 | $2.3 \times 10^2$(mold) | $5.0 \times 10^1$(mold) |
| Day 28 | <10 | <10 | $9.0 \times 10^1$(mold) | <10 |

TABLE 9

| Bacchus with 0.05% TBHQ Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | <10 | <10 | $6.6 \times 10^2$(mold) | $4.0 \times 10^3$(mold) |
| Day 7 | <10 | <10 | $6.2 \times 10^2$(mold) | $7.4 \times 10^2$(mold) |
| Day 14 | <10 | <10 | $1.2 \times 10^2$(y & m) | $1.0 \times 10^1$(mold) |
| Day 21 | <10 | <10 | $2.2 \times 10^2$(mold) | <10 |
| Day 28 | <10 | <10 | $6.0 \times 10^1$(mold) | <10 |

TABLE 10

| Bacchus with 30 ppm choline polyhalide triiodide Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | <10 | <10 | $1.0 \times 10^3$(mold) | $9.0 \times 10^3$(mold) |
| Day 7 | <10 | <10 | $9.0 \times 10^3$(mold) | $8.0 \times 10^2$(mold) |
| Day 14 | <10 | <10 | $3.2 \times 10^2$(y & m) | $3.3 \times 10^2$(mold) |
| Day 21 | <10 | <10 | $3.2 \times 10^2$(mold) | $4.1 \times 10^2$(mold) |
| Day 28 | <10 | <10 | $3.2 \times 10^2$(mold) | $3.0 \times 10^1$(mold) |

TABLE 11

| Hercules with 0.05% BHA Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | $1.6 \times 10^5$ | <10 | $8.6 \times 10^2$(y & m) | $2.9 \times 10^2$(mold) |
| Day 7 | $1.9 \times 10^3$ | $8.0 \times 10^1$ | $2.0 \times 10^2$(y & m) | $7.0 \times 10^2$(mold) |
| Day 14 | <10 | <10 | $6.0 \times 10^1$(mold) | $4.0 \times 10^1$(mold) |
| Day 21 | <10 | <10 | $2.0 \times 10^1$(mold) | <10 |
| Day 28 | <10 | <10 | <10 | <10 |

TABLE 12

| Hercules with 0.05% BHT Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | $2.6 \times 10^5$ | <10 | $4.4 \times 10^4$(y & m) | $3.8 \times 10^2$(mold) |
| Day 7 | $7.6 \times 10^7$* | $1.0 \times 10^2$ | $1.2 \times 10^4$(mold) | $7.2 \times 10^2$(mold) |
| Day 14 | $1.0 \times 10^1$ | <10 | $7.0 \times 10^1$(mold) | $7.0 \times 10^1$(mold) |
| Day 21 | <10 | <10 | $1.0 \times 10^1$(mold) | <10 |
| Day 28 | <10 | <10 | <10 | <10 |

*estimated count

TABLE 13

| Hercules with 0.05% Methyl Paraben Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | <10 | <10 | <10 | <10 |
| Day 7 | <10 | <10 | <10 | <10 |
| Day 14 | <10 | <10 | <10 | <10 |
| Day 21 | <10 | <10 | <10 | <10 |
| Day 28 | <10 | <10 | <10 | <10 |

TABLE 14

| Hercules with 0.05% TBHQ Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | <10 | <10 | $4.0 \times 10^3$(mold) | <10 |
| Day 7 | <10 | <10 | $5.3 \times 10^2$(mold) | $4.6 \times 10^2$(mold) |
| Day 14 | <10 | <10 | $1.0 \times 10^1$(mold) | <10 |
| Day 21 | <10 | <10 | <10 | <10 |
| Day 28 | <10 | $1.1 \times 10^2$ | <10 | <10 |

TABLE 15

| Poseidon with 0.05% BHA Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | $5.8 \times 10^7$* | $1.5 \times 10^3$ | $1.7 \times 10^5$(y & m) | $2.5 \times 10^3$(y & m) |
| Day 7 | $4.2 \times 10^7$* | $1.1 \times 10^5$* | $4.8 \times 10^5$*(y & m) | $2.2 \times 10^4$(y & m) |
| Day 14 | $6.8 \times 10^6$ | $5.0 \times 10^4$ | $1.1 \times 10^6$(y & m) | $1.7 \times 10^3$(y & m) |
| Day 21 | $1.3 \times 10^7$ | $1.9 \times 10^4$ | $2.2 \times 10^5$(y & m) | $5.6 \times 10^2$(y & m) |
| Day 28 | $4.2 \times 10^6$ | $7.0 \times 10^3$ | $6.6 \times 10^4$(y & m) | $1.3 \times 10^2$(y & m) |

*estimated count

TABLE 16

| Poseidon with 0.05% BHT Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | $6.5 \times 10^7$ | $<3.4 \times 10^3$* | $2.0 \times 10^3$(y & m) | $2.0 \times 10^3$ |
| Day 7 | $5.8 \times 10^7$ | $2.6 \times 10^5$ | $3.7 \times 10^5$(y & m) | $6.5 \times 10^3$(y & m) |
| Day 14 | $5.0 \times 10^6$ | $5.5 \times 10^4$ | $3.3 \times 10^5$(y & m) | $2.0 \times 10^3$(y & m) |
| Day 21 | $9.1 \times 10^6$ | $3.7 \times 10^4$ | $2.6 \times 10^5$(y & m) | $2.1 \times 10^3$(y & m) |
| Day 28 | $5.1 \times 10^6$ | $1.5 \times 10^4$ | $1.3 \times 10^5$(y & m) | $3.9 \times 10^2$(y & m) |

*estimated count

TABLE 17

| Poseidon with 0.05% Methyl Paraben Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | <10 | $<7.0 \times 10^3$ | $1.9 \times 10^2$(yeast) | <10 |
| Day 7 | <10 | <10 | <10 | <10 |
| Day 14 | <10 | <10 | <10 | <10 |
| Day 21 | <10 | <10 | <10 | <10 |
| Day 28 | <10 | <10 | <10 | <10 |

TABLE 18

| Poseidon with 0.05% TBHQ Plate Counts (CFU/mL) | | | | |
|---|---|---|---|---|
| | Pre-inoculation Initial Count in Test Suspension | | | |
| | BACTERIA COUNTS <1 $4.0 \times 10^6$ | | YEAST & MOLD COUNTS <1 $1.7 \times 10^5$ | |
| Sampling Time | Sampled from Aqueous Layer | Sampled from Oil Layer | Sampled from Aqueous Layer | Sampled from Oil Layer |
| Day 4 | $1.4 \times 10^7$ | <10 | $1.8 \times 10^5$(y & m) | $7.2 \times 10^2$(mold) |
| Day 7 | $4.4 \times 10^6$ | $1.2 \times 10^5$ | $2.4 \times 10^4$(y & m) | $1.1 \times 10^4$(y & m) |
| Day 14 | $1.8 \times 10^6$ | $4.3 \times 10^4$ | $5.0 \times 10^3$(mold) | $5.4 \times 10^1$(y & m) |
| Day 21 | $1.5 \times 10^6$ | $4.2 \times 10^4$ | $8.0 \times 10^3$(y & m) | $8.8 \times 10^2$(y & m) |
| Day 28 | $2.9 \times 10^5$ | $1.2 \times 10^4$ | $9.0 \times 10^3$(y & m) | $2.8 \times 10^2$(y & m) |

EXAMPLE 3

Bacteria plate counts and yeast/mold counts were taken weekly on samples of oil containing antimicrobial agent from a food processing plant. The food processing plant is in the industry of preparing frozen entrees, pouched food products, and gravy and cheese sauces. Samples were obtained from four pumps. Pumps 1–3 are food product transfer pumps. Pump 4 is a food mix kettle agitator gear box. The oil was prepared by mixing Bacchus 220 oil from Vlucan Oil and Chemical Products with 0.05% methyl paraben.

Existing oil in each of the gear boxes for each pump was drained and replaced with the above-identified lubricant composition. It is believed that the oil provided in each gear box is an approximate mixture of about 80% of the above-described oil and 20% of oil which remain in each gear box after draining.

Samples were taken weekly. Microbial levels were determined using colony count methods (pour plate technique). Standard plate counts were determined on the plating media of Typtone Glucose Extract Agar (TGE). The yeast and mold counts were enumerated with the plating media of Sabouraud Dextrose Agar with 1.0% added antibiotics (SAB-A).

The results of this example are reported in the following tables.

TABLE 19

| Pump 1 | | | | |
|---|---|---|---|---|
| Time after Introduction of Oil | Bacteria Plate Count (CFU/mL) | Yeast/Mold Count (CFU/mL) | Gram Stain Results | Identification |
| 1 week | <10 | $1.7 \times 10^2$ (yeast) | On TGE: yeast | *Candida* sp. |
| 2 weeks | <10 | $1.6 \times 10^3$ (yeast) | Not performed (same morphology as first sample) | *Candida famata* |
| 3 weeks | <10 | $3.3 \times 10^3$ (yeast) | On TGE: yeast | *Cryptococcus* sp. |

TABLE 19-continued

| Pump 1 | | | | |
|---|---|---|---|---|
| Time after Introduction of Oil | Bacteria Plate Count (CFU/mL) | Yeast/Mold Count (CFU/mL) | Gram Stain Results | Identification |
| 4 weeks | <10 | <10 | — | — |

TABLE 20

| Pump 2 | | | | |
|---|---|---|---|---|
| Time after Introduction of Oil | Standard Plate Count (CFU/mL) | Yeast/Mold Count (CFU/mL) | Gram Stain Results or Mold Description | Identification |
| 1 week | <10 | <10 | — | — |
| 2 weeks Water layer | $2.2 \times 10^7$ | $1.6 \times 10^3$ (y & m) | Very short Gram negative bacilli, oxidase negative | *Enterobacter cloacae* Yeast: *Candida glabrata* |
| | | | Mold: White feltlike growth with orange reverse | Mold: Unable to identify |
| Oil layer | $2.2 \times 10^5$ | $4.7 \times 10^2$ (y & m) Same morphology as in water layer | A) Short Gram negative bacilli, oxidase negative | *Enterobacter cloacae* |
| | | | B) Medium length Gram negative bacilli, in strings: oxidase positive | Possible *Stenotrophomonas maltophilia* |
| | | | C) Very short Gram negative bacilli, oxidase negative | *Klebsiella pneumoniae* |
| 3 weeks | <10 | <10 | — | — |
| 4 weeks | <10 | <10 | — | — |

TABLE 21

| Pump 3 | | | | |
|---|---|---|---|---|
| Time after Introduction of Oil | Standard Plate Count (CFU/mL) | Yeast/Mold Count (CFU/mL) | Gram Stain Results or Mold Description | Identification |
| 1 week | $7.5 \times 10^6$ | $4.2 \times 10^2$ (yeast) | Short Gram negative bacilli, oxidase negative | *Enterobacter cloacae* Yeast: *Candida guilliermondii* |
| 2 weeks | $9.7 \times 10^4$ | <10 | Short Gram negative bacilli, oxidase positive | *Pseudomonas aeruginosa* |
| 3 weeks | $3.7 \times 10^3$ (estimated count) | $4.4 \times 10^2$ (yeast & mold) Could not isolate yeast to ID; it was overgrown by mold | A) Short Gram negative bacilli, oxidase negative | *Klebsiella pneumoniae* |
| | | | B) Short Gram negative bacilli, oxidase positive | *Pseudomonas aeruginosa* |
| | | | C) Short Gram negative bacilli, oxidase negative | *Citrobacter freundii* |
| | | | Mold: Gray, very fuzzy, pale yellow reverse | Mold: *Rhizopus* sp. |

TABLE 21-continued

| Pump 3 | | | | |
|---|---|---|---|---|
| Time after Introduction of Oil | Standard Plate Count (CFU/mL) | Yeast/Mold Count (CFU/mL) | Gram Stain Results or Mold Description | Identification |
| 4 weeks | $2.1 \times 10^5$ | <10 | Short Gram negative bacilli oxidase negative | *Escherichia coli* |

TABLE 22

| Pump 4 | | | | |
|---|---|---|---|---|
| Time after Introduction of Oil | Standard Plate Count (CFU/mL) | Yeast/ Mold Count (CFU/mL) | Gram Stain Results or Mold Description | Identification |
| 1 week | $1.0 \times 10^1$ | <10 | Long Gram negative bacilli oxidase negative | *Pasteurella haemolytica* |
| 2 weeks | $1.0 \times 10^1$ (mold) | <10 | Mold: Neat, round colony, gray-green with white outside ring & orange reverse | Mold: Unable to identify |
| 3 weeks | <10 | <10 | — | — |
| 4 weeks | <10 | <10 | — | — |

The above specification, examples and data provide a complete description of the manufacture and use of the composition of the invention. Since many embodiments of the invention can be made without departing from the spirit and scope of the invention, the invention resides in the claims hereinafter appended.

We claim:

1. A lubricant composition comprising:

(a) food machinery lubricant comprising at least one of oils and greases; and (b) antimicrobially effective amount of an antimicrobial agent comprising at least one of polyhalides, interhalides, iodophores, percarboxylic acids, quaternary compounds, and mixtures thereof, wherein the antimicrobial agent exhibits a partition coefficient between water and said food machinery lubricant of between about 0.01 and about 1,000 and said lubricant composition provides at least a two log reduction in bacteria in water in about two weeks or at least a two log reduction in mold and yeast in water in about one month from a concentration of bacteria of between $10^5$ and $10^6$ CFU/ml and a mold and yeast concentration of between $10^5$ and $10^6$ CFU/ml.

2. A lubricant composition according to claim 1, wherein the antimicrobial agent is provided in the lubricant composition at a concentration of up to about 10 wt.%.

3. A lubricant composition according to claim 1, wherein the antimicrobial agent comprises a polyhalide.

4. A lubricant composition according to claim 1, wherein the antimicrobial agent comprises a percarboxylic acid.

5. A lubricant composition according to claim 1, wherein the antimicrobial agent comprises a quaternary ammonium compound.

6. A lubricant composition according to claim 1, wherein the antimicrobial agent comprises a quaternary phosphonium compound.

7. A lubricant composition according to claim 1, wherein the antimicrobial agent comprises an interhalide.

8. A lubricant composition according to claim 1, wherein the antimicrobial agent comprises an iodophore.

9. A lubricant composition according to claim 1, wherein the antimicrobial agent provides a partition coefficient between water and said food machinery lubricant of between about 0.1 and 100.

10. A lubricant composition according to claim 1, wherein the antimicrobial agent provides a partition coefficient between water and said food machinery lubricant of between about 0.2 and about 20.

11. A method for manufacturing a lubricant composition, the method comprising a step of:

(a) mixing food machinery lubricant and an antimicrobially effective amount of an antimicrobial agent, wherein:

(i) the food machinery lubricant comprises at lest one of oils and greases; and (ii) the antimicrobial agent comprises at least one of polyhalides, interhalides, iodophores, percarboxylic acids, quaternary compounds, and mixtures thereof;

(iii) the antimicrobial agent exhibits a partition coefficient between water and said food machinery lubricant of between about 0.001 and about 1,000; and (iv) said lubricant composition exhibits at least a two log reduction in bacteria in about two weeks or at least a two log reduction in mold and yeast in about one month from a concentration of bacteria of between $10^5$ and $10^6$ CFU/ml and a mold and yeast concentration of between $10^5$ and $10^6$ CFU/ml.

12. A method according to claim 11, wherein the antimicrobial agent is provided in the lubricant composition at a concentration of up to about 10 wt. %.

13. A method according to claim 11, wherein the antimicrobial agent comprises a polyhalide.

14. A method according to claim 11, wherein the antimicrobial agent comprises a percarboxylic acid.

15. A method according to claim 11, wherein the antimicrobial agent compries a quaternary ammonium compound.

16. A method according to claim 11, wherein the antimicrobial agent comprises a quaternary phosphonium compound.

17. A method according to claim 11, wherein the antimicrobial agent comprises an interhalide.

18. A method according to claim 11, wherein the antimicrobial agent comprises an iodophore.

19. A method according to claim 11, wherein the antimicrobial agent provides a partition coefficient between water and said food machinery lubricant of between about 0.1 and and 100.

20. A method according to claim 11, whereing the antimicrobial agent provides a partition coefficient between water and said food machinery lubricant of between about 0.2 and about 20.

21. A method for using a lubricant composition, the method comprising a step of:

(a) introducing a lubricant composition into machinery to provide lubrication, wherein:

(i) said lubricant composition comprising a food machinery lubricant and an antimicrobially effective amount of an antimicrobial agent exhibiting a partition coefficient between water and said food machinery lubricant of between about 0.10 and about 1,000;

(ii) said machinery comprises at least one of gear boxes, pumps, hydraulic system, agitators, and grinders;

(iii) said antimicrobial agent comprises at least one of polyhalides, interhalides, iodophores, percarboxylic acids, quaternary compounds, and mixtures thereof; and (iv) said lubricant composition exhibits at least a two log reduction in bacteria in about two weeks or at least a two log reduction in mold and yeast in about one month from a concentration of bacteria of between $10^5$ and $10^6$ CFU/ml and a mold and yeast concentration of between $10^5$ and $10^6$ CFU/ml.

22. A method according to claim 21, wherein the antimicrobial agent is provided in the lubricant composition at a concentration of up to about 10 wt. %.

23. A method according to claim 21, wherein the antimicrobial agent comprises a polyhalide.

24. A method according to claim 21, wherein the antimicrobial agent comprises a percarboxylic acid.

25. A method according to claim 21, wherein the antimicrobial agent comprises a quarternary ammonium compound.

26. A method according to claim 21, wherein the antimicrobial agent comprises a quaternary phosphonium compound.

27. A method according to claim 21, wherein the antimicrobial agent comprises an interhalide.

28. A method according to claim 21, wherein the antimicrobial agent comprises an iodophore.

29. A method according to claim 21, wherein the antimicrobial agent provides a partition coefficient between water and said food machinery lubricant of between about 0.1 and about 100.

30. A method according to claim 21, wherein the antimicrobial agent provides a partition coefficient between water and said food machinery lubricant of between about 0.2 and about 20.

* * * * *

UNITED STATES PATENT AND TRADEMARK OFFICE

CERTIFICATE OF CORRECTION

PATENT NO. : 6,475,961 B2
DATED : November 5, 2002
INVENTOR(S) : Lokkesmoe et al.

It is certified that error appears in the above-identified patent and that said Letters Patent is hereby corrected as shown below:

Column 4,
Line 51, “defmed as a paraffmic” should read -- defined as a paraffinic --

Column 8,
Line 22, “pemonanoic” should read -- pernonanoic --

Column 9,
Line 17, “Bis-quatemary” should read -- Bis-quaternary --

Column 23,
Line 48, “Vlucan” should read -- Vulcan --

Signed and Sealed this

Twenty-fifth Day of March, 2003

JAMES E. ROGAN
*Director of the United States Patent and Trademark Office*